US005692712A

United States Patent [19]

Weinschenk, Jr. et al.

[11] Patent Number: 5,692,712

[45] Date of Patent: Dec. 2, 1997

[54] DESK-MOUNTED SUPPORTS FOR COMPUTER ACCESSORIES

[75] Inventors: Lavern L. Weinschenk, Jr., Davenport, Iowa; Jay R. Machael, Rock Island, Ill.

[73] Assignee: Ring King Visibles, Inc., Muscatine, Iowa

[21] Appl. No.: 608,601

[22] Filed: Feb. 29, 1996

[51] Int. Cl.[6] ..... A47B 21/02

[52] U.S. Cl. ..... 248/118; 248/118.3; 248/918; 248/295.11; 248/297.31; 108/108; 108/110; 400/715; D14/114

[58] Field of Search ..... 248/918, 118, 248/118.1, 118.3, 118.5, 161, 410, 226.11, 230.1, 297.31, 297.51, 295.11, 321, 323, 916, 125.1, 125.3; D14/114; 312/223.3; 400/715; 108/92, 96, 108, 110, 50, 143, 144; 297/338

[56] References Cited

U.S. PATENT DOCUMENTS

| | | | |
|---|---|---|---|
| 3,502,188 | 3/1970 | Blaha et al. | 400/480 |
| 4,316,082 | 2/1982 | Fritz | 235/146 |
| 4,616,798 | 10/1986 | Smeenge et al. | 248/281.1 |
| 4,632,349 | 12/1986 | Anstey | 248/281.1 |
| 4,657,214 | 4/1987 | Foster | 248/176 |
| 4,688,862 | 8/1987 | Fowler et al. | 312/325 |
| 4,693,444 | 9/1987 | Williams et al. | 248/653 |
| 4,706,919 | 11/1987 | Soberalski et al. | 248/281.1 |
| 4,708,312 | 11/1987 | Rohr | 248/280.1 |
| 4,709,972 | 12/1987 | LaBudde et al. | 312/208 |
| 4,776,284 | 10/1988 | McIntosh | 108/138 |
| 4,779,922 | 10/1988 | Cooper | 297/188 |
| 4,844,388 | 7/1989 | Kuba et al. | 248/1 |
| 5,037,054 | 8/1991 | McConnell | 248/284 |
| 5,040,760 | 8/1991 | Singer | 248/284 |
| 5,048,784 | 9/1991 | Schwartz et al. | 248/244 |
| 5,058,840 | 10/1991 | Moss et al. | 248/118.5 |
| 5,074,501 | 12/1991 | Holtta | 248/118.3 |
| 5,145,136 | 9/1992 | McConnell | 248/284 |
| 5,211,367 | 5/1993 | Musculus | 248/279 |
| 5,230,289 | 7/1993 | George et al. | 108/2 |
| 5,257,767 | 11/1993 | McConnell | 248/284 |
| 5,302,015 | 4/1994 | Du Vall | 312/282 |
| 5,405,204 | 4/1995 | Ambrose | 400/472 |

FOREIGN PATENT DOCUMENTS

WO89001111 1/1989 WIPO .

*Primary Examiner*—Leslie A. Braun
*Assistant Examiner*—Donald J. Wallace
*Attorney, Agent, or Firm*—Jones, Day, Reavis & Pogue

[57] ABSTRACT

A support assembly for a computer input device includes a generally C-shaped slide member mountable to the underside of a desk surface for slidingly receiving a vertical column member. Notches formed in the column member are engaged by teeth of a collar portion of a support arm. The arm is thereby adjustable to various vertical positions on the column. A computer keyboard or mouse pad may thereby by supported on the arm with both height adjustability and the ability to be retractable beneath the desk surface. Where the assembly is used to support a keyboard, a slide arm supporting the keyboard may be provided with ribs engaging slots of the support arm. By configuring the support arm with an S-shaped side elevation, movement of the slide arm on the support will allow the keyboard to tilt through a negative angle permitting the keyboard operator to adjust the angle of tilt to a comfortable neutral tilt position.

17 Claims, 5 Drawing Sheets

DESK-MOUNTED SUPPORTS FOR COMPUTER ACCESSORIES

BACKGROUND OF THE INVENTION

1. Field of the Invention

The present invention relates generally to desk-mounted support structures for computer accessories and, more particularly, to structures capable of supporting computer keyboards, mouse pads and lap top computers such that these accessories can be conveniently adjusted to a desired position and stored under the desk when not in use.

2. Description of the Prior Art

With advancements in information technology, increasing numbers of individuals now use computers in some form. Typically, computers for processing data are accessed by a terminal which includes a visual display, or monitor, and keyboard. Increasingly, computer operators have begun using computer programs which require a mouse to process data. The mouse is operable with one hand to move indicia about the screen of the computer display and activate functions of the system software. Typically, the computer operator will have both a keyboard and a mouse disposed in close proximity on a desk or table such that both devices may be manually operated as the operator sits in an adjacent chair.

It is generally the case that a standard desk or table suitable for use in an office environment has a work surface elevated from the floor by too great a height for comfortable operation of a computer keyboard placed thereon. The normal level of the keyboard operator's hands as he or she sits in a standard height office chair is somewhat lower than the typical desk top. Accordingly, for comfort in using a keyboard it is generally undesirable to position the keyboard on the work surface of the conventional office desk. Thus, in recent times, desks have been made with keyboard platforms which are lower than the work surface of the desk. In one such form of desk, the keyboard platform is supported on slides fixed beneath the desk top surface as to be retractable under the desk top surface. This type of desk construction offers the advantages of permitting the keyboard to be elevated at a comfortable position of operation while freeing the desk work surface for supporting other office equipment or for use in other office activities. Of course, the keyboard may also be conveniently stored in a retracted position under the desk top when not in use. However, a disadvantage of such a desk construction is that the keyboard is constrained to one fixed elevation which may not be a preferred elevation for all users.

In order to provide for greater adjustability of keyboards, various devices exist for movably supporting keyboards from beneath a desk top such that the elevation of the keyboard can be varied to suit the preferences of the user. One such device is disclosed, for example, in U.S. Pat. No. 4,632,349 issued to Anstey. Typically, these devices comprise a pantograph or parallelogram linkage mechanism which permits a keyboard table to be raised or lowered while maintaining the table in a horizontal disposition. In the Anstey example, the table is supported by a gas spring assisted pivotable arm. However, a disadvantage of known keyboard height adjustable supports is that these devices often have complex mechanisms which are relatively costly to manufacture. Accordingly, they represent a considerable expense to the consumer.

Another desirable feature to have in keyboard support devices is tilt adjustability of the keyboard. It has been discovered in recent times that people who use keyboards frequently and over long periods of time can experience discomfort as a result of strain to the wrists from operating the keyboard with wrist flexion. Such strain placed on the wrist extensors and their tendons, as well as the tensile stresses placed on the anterior wrist connective tissues, can lead to hypertrophy of the ligaments which causes carpal tunnel syndrome. Accordingly, it is advisable for frequent users of keyboards to have tiltable keyboards which can be adjusted to place the wrists in a more neutral or natural disposition. It is thought that a keyboard having a negative angle of tilt is most desirable to avoid wrist fatigue and carpal tunnel syndrome. Many devices have long been available for either permanently or adjustably tilting a keyboard. Moreover, this feature is available in keyboard supports which are also height adjustable. However, again, these devices typically involve complex and expensive mechanisms which are relatively costly to manufacture.

Accordingly, it is desirable to provide a support mechanism for a computer accessory such as a keyboard or mouse pad which permits the accessory to not only be retractable from under a desk top but also be height adjustable. It is further desirable to provide such a support mechanism which permits an associated keyboard to also be tilt adjustable. Further, it is desirable to provide such an accessory mechanism which is reliable in use yet is relatively inexpensive to manufacture.

SUMMARY OF THE INVENTION

The present invention improves over the prior art by providing a support assembly for a computer input device or accessory wherein the assembly includes a generally C-shape slide member mountable to the underside of a desk surface for slidingly receiving a vertical column member. Notches formed in the column member are engaged by teeth of a collar portion of a support arm. The arm is thereby adjustable to various vertical positions on the column as the collar portion is fitted over the column. A computer keyboard or mouse pad may thereby be supported on the arm with both height adjustability and the ability to be retractable underneath the desk surface. Where the assembly is used to support a keyboard, a slide arm supporting the keyboard may be provided with ribs engaging slots of the support arm. By configuring the support arm with an S-shaped side elevation, movement of the slide arm on the support arm will allow the keyboard to tilt through a negative angle permitting the keyboard operator to adjust the angle of tilt of the keyboard to a comfortable neutral wrist position. The support assembly can be manufactured with few components and by standard plastic injection molding techniques. It is, therefore, capable of being produced in a highly economical manner.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
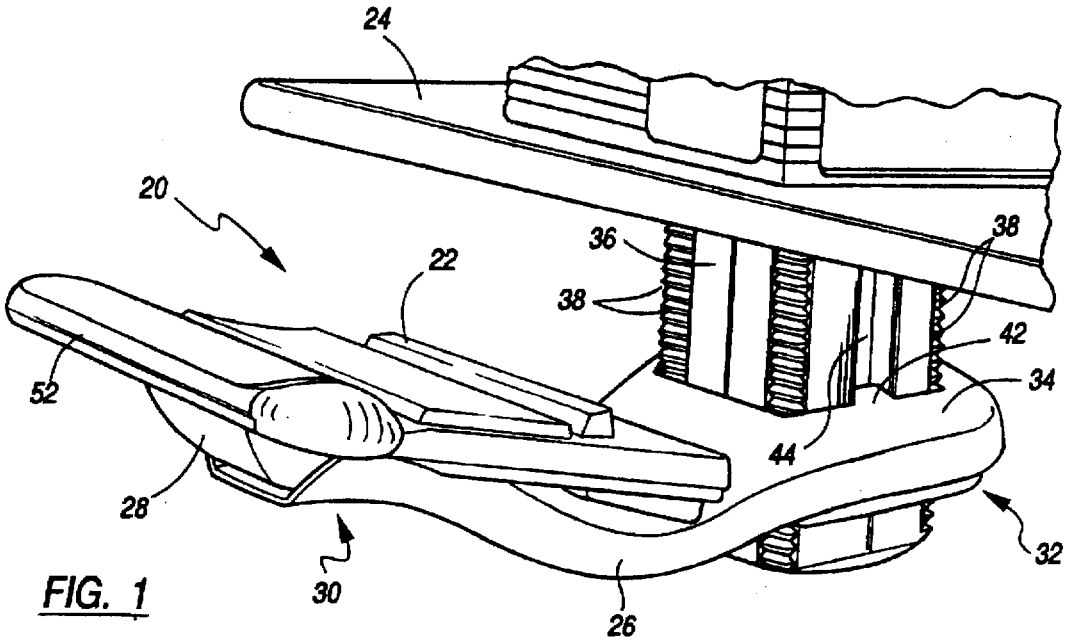
FIG. 1 is a side perspective view of a computer keyboard support assembly constructed in accordance with the principles of the invention and shown as mounted under a desk surface.
Figure 2:
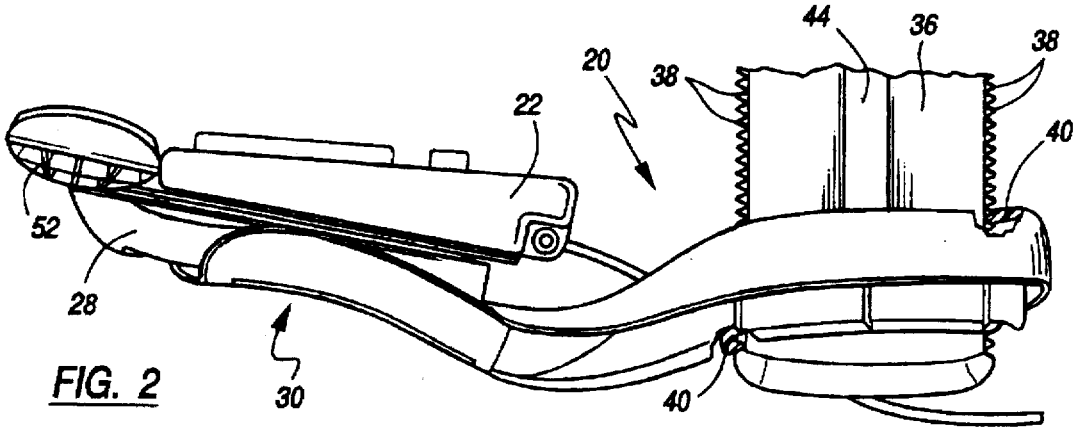
FIG. 2 is a fractional side elevational view thereof showing the support assembly locked in a first vertical position relative to the desk surface.
Figure 3:
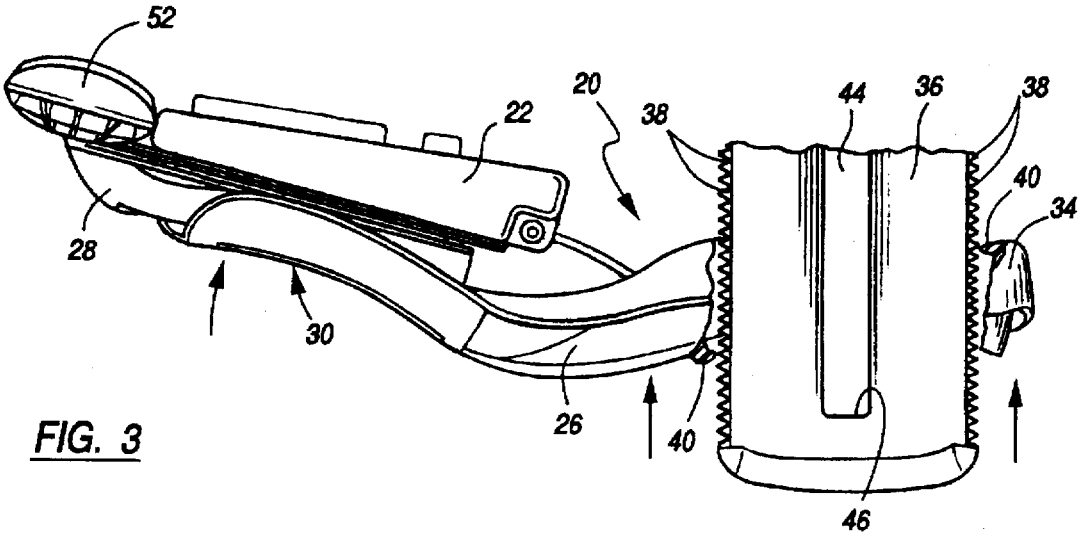
FIG. 3 is a fractional side elevational view thereof showing the support assembly being moved to another vertical position.

Referring now to the drawings, and initially to FIGS. 1–3, in one form of the invention a support assembly 20 for a computer keyboard 22 is shown as mounted to the underside of a desk surface 24. The assembly 20 includes as its principal components a support arm 26 having a slide arm 28 fitted as will be described hereinafter at a first end 30 of the support arm 26. The other end 32 of the support arm 26 is configured with a collar portion 34. The collar portion 34 fits somewhat loosely around a generally elongate column 36 as to be movable vertically relative to the desk surface 24. A series of opposed notches 38 are formed in the column 36 facing both forwardly and rearwardly of the column. The collar portion 34 is provided with pairs of opposed teeth 40 aligned in registry with the column notches 38. Thus, as best seen in FIG. 2, the teeth 40 may engage the notches 38 to retain the arm 26 under the influence of gravity in a variety of vertical positions along the column 36 whereby the keyboard 22 may be adjusted to through a relatively wide range heights relative to the desk surface 24. As best seen in FIG. 3, to adjust the height of the keyboard 22, the support arm 26 is simply lifted by the end 30 causing the collar portion 34 to cock slightly whereupon the teeth 40 disengage from the notches 38 making the collar portion 34 free to move up or down the column 36. In order to limit extreme lower movement of the arm 26, the collar portion 34 is provided with a pair of opposed lugs 42 projecting inwardly into channels 44 formed in the column 36 (FIG. 1). The lugs 42 bottom on lower channel surfaces 46 thus preventing inadvertent disconnection of the arm 26 from the column 36 (FIG. 3).

Figure 4:
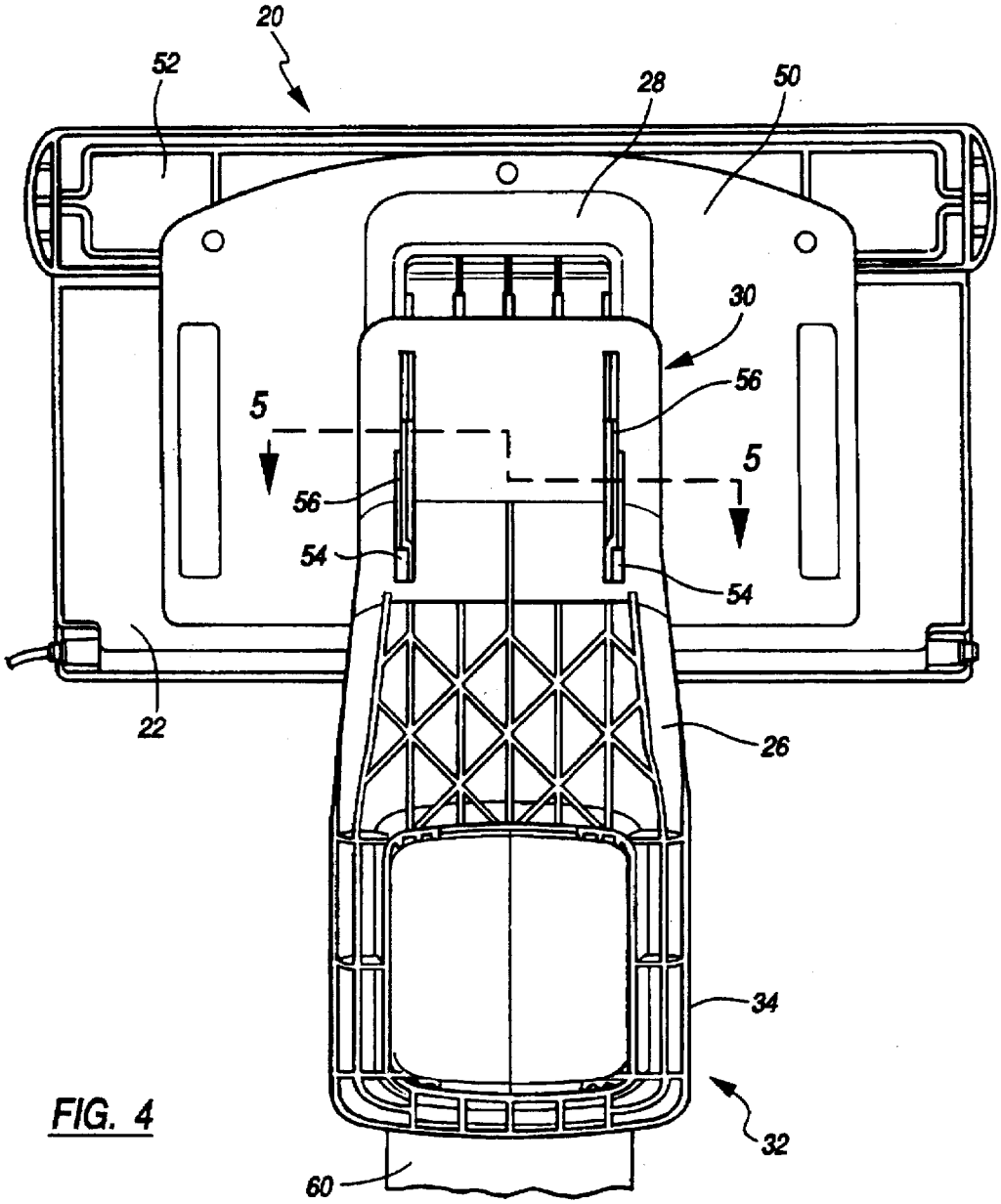
FIG. 4 is a bottom plan view of the assembly.
Figure 5:
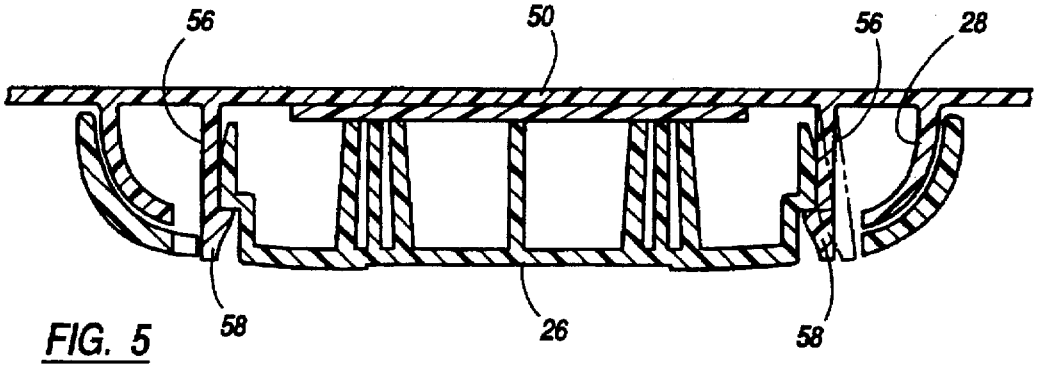
FIG. 5 is a cross-sectional view taken substantially along the line 5—5 of FIG. 4.

Turning now to FIGS. 4 and 5, the slide arm 28 may be seen to include a plate 50 suitably dimensioned and configured to support the keyboard 22. The keyboard may be secured to the plate 50 by any suitable means such as hook and loop fasteners (not shown). A padded wrist rest 52 may also be attached to the plate. In accordance with the invention, the support assembly 20 provides a keyboard tilt feature provided by lengthwise slots 54 formed in the support arm 26 in which ribs 56 of the slide arm 28 are slidingly received. The slide arm 28 is secured to the support arm 26 by snapping the ribs 56 into the slots 54 whereupon ramped ends 58 of the ribs 56 engage the support arm 26 and prevent removal of the slide arm 28. However, the slide arm 28 is free to slide with a degree of friction fore and aft of the support arm 26.

Figure 6:
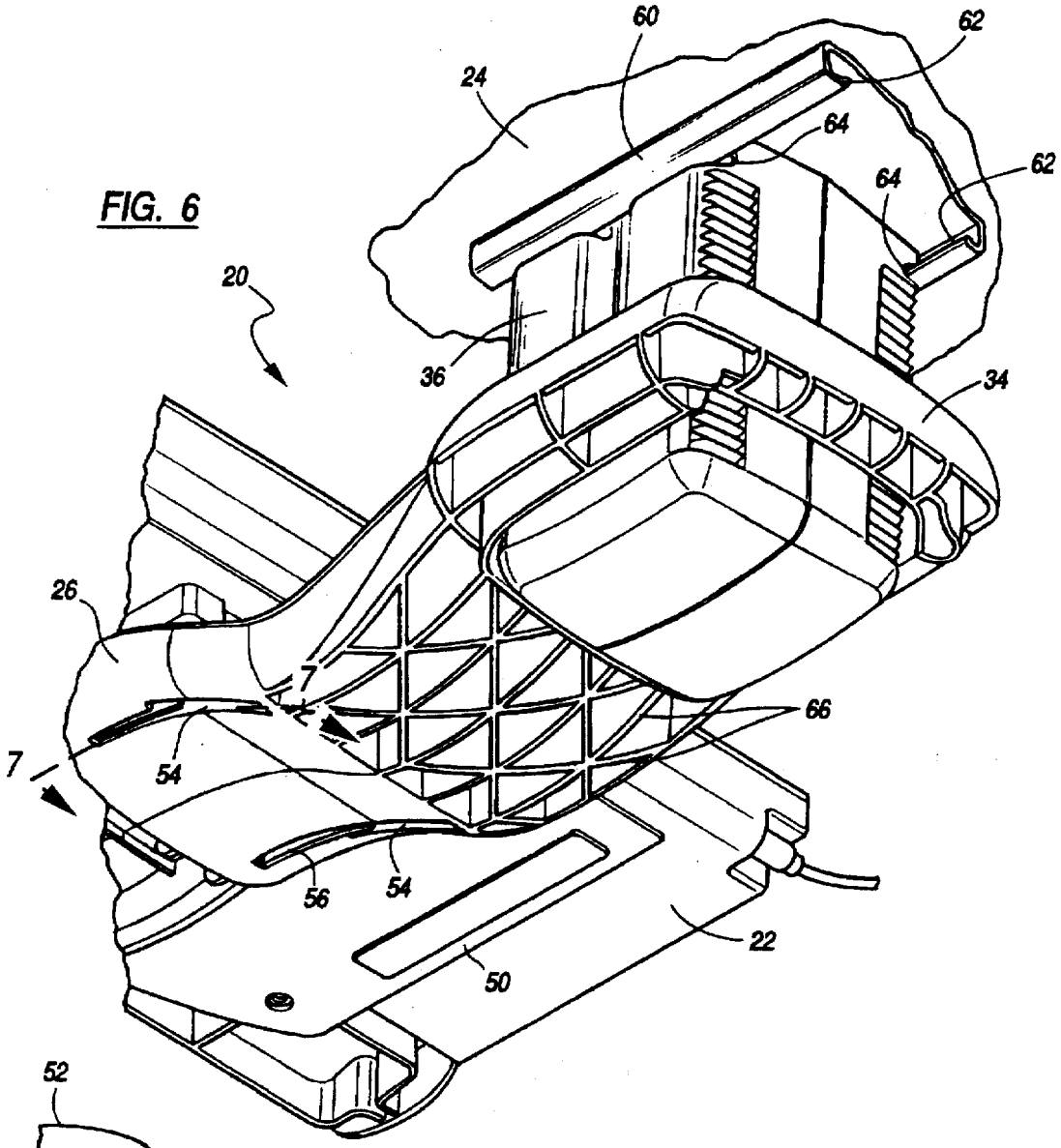
FIG. 6 is a fractional bottom perspective view of the assembly.

Referring now to FIG. 6, an underside view of the assembly 20 shows the means for mounting the assembly to the desk surface 24 using a generally elongate slide member 60 secured as by suitable screws from front to back of the underside of the surface 24. The slide member 60 has a generally C-shaped cross section defining edges 62 which are received by notches 64 formed in the upper side walls of the column 36. Thus, the column 36 is free to slide with a degree of friction fore and aft of the desk surface 24. This mounting arrangement allows the keyboard 22 to be fully retractable from beneath the desk surface 24 so that the keyboard may be conveniently stored out of the way when desired. In FIG. 6, it can also be seen that the support arm 26 is preferably a molded member configured with a plurality of reinforcing ribs 66.

Figure 7:
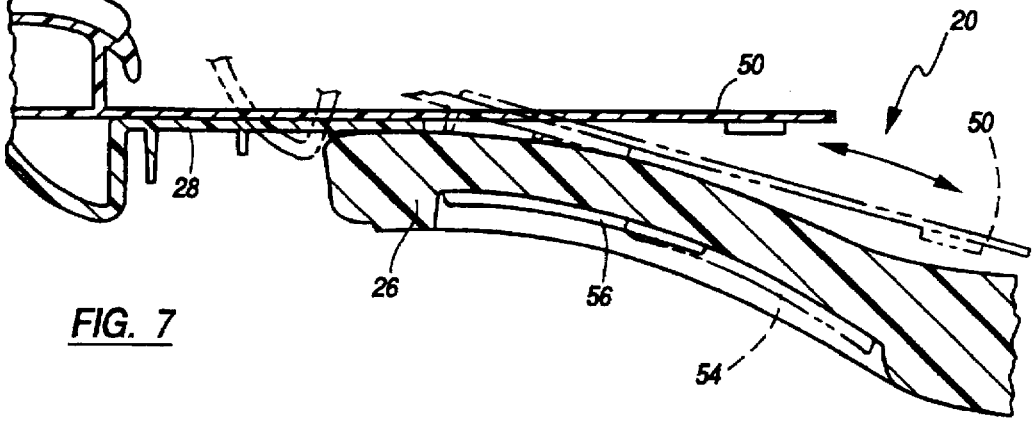
FIG. 7 is a cross-sectional view taken substantially along the line 7—7 of FIG. 6.

In the side view of FIG. 7, it can be seen that the support arm 26 preferably has a generally S-shaped configuration and, therefore, the slots 54 and associated ribs 56 are slightly curved. Thus, as the slide arm 28 is moved rearward of the support arm 26 guided by the ribs 56 and slots 54, the keyboard support plate 50 moves through declining or negative angles of tilt. In practice, the degree of negative tilt is preferably on the order of from zero to fifteen degrees. As a result of this feature, the keyboard user may adjust the tilt of the keyboard to a desired angle which will allow his or her wrists to assume a neutral or natural disposition. Thereby, the user will experience less strain on the wrists when operating the keyboard over extended periods of time.

Figure 8:
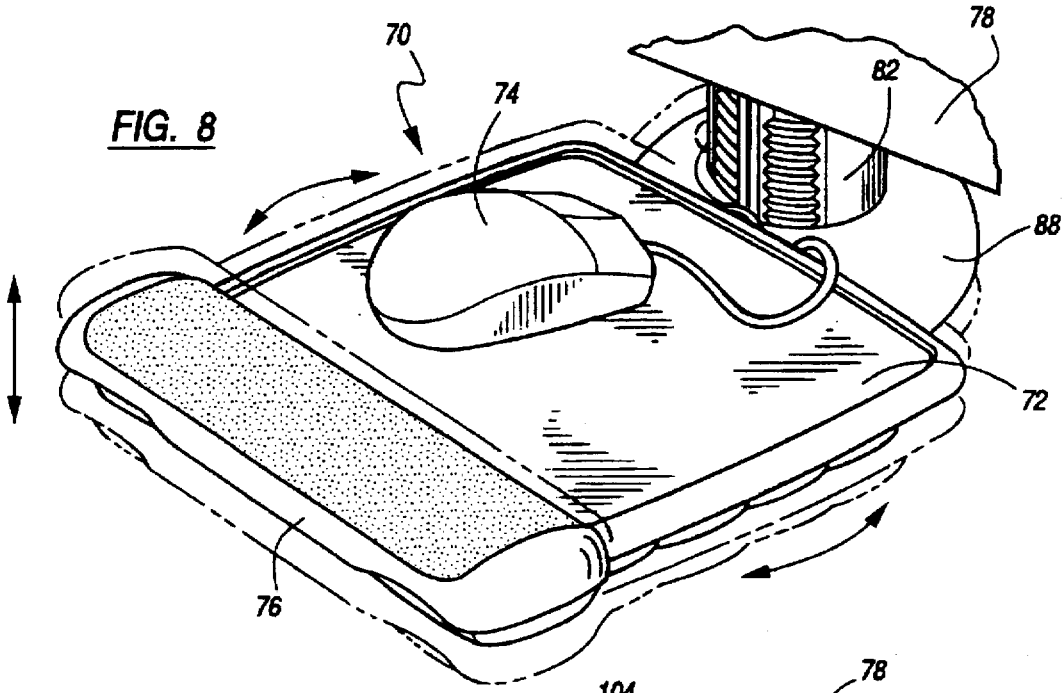
FIG. 8 is a side perspective view of a second embodiment of the invention showing a mouse pad supported from the underside of a desk surface in a manner similar to the keyboard support assembly.
Figure 9:
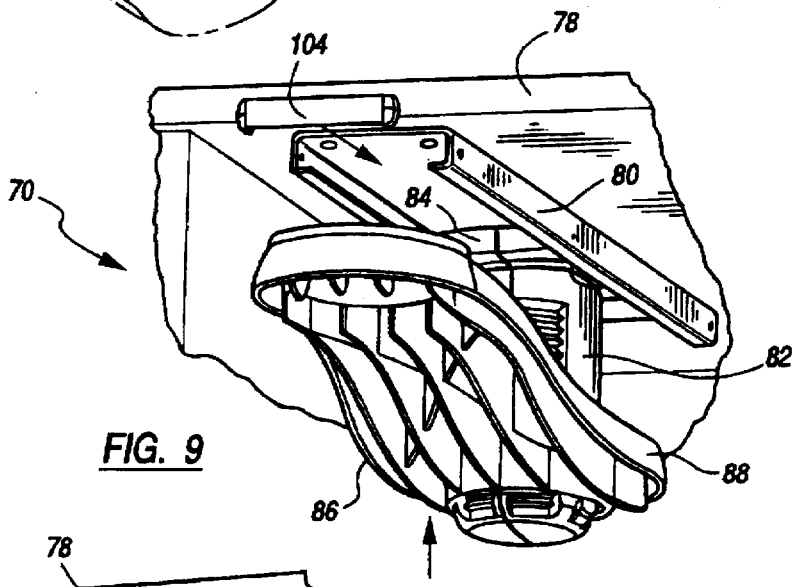
FIG. 9 is a side perspective view thereof with the mouse pad removed.
Figure 10:
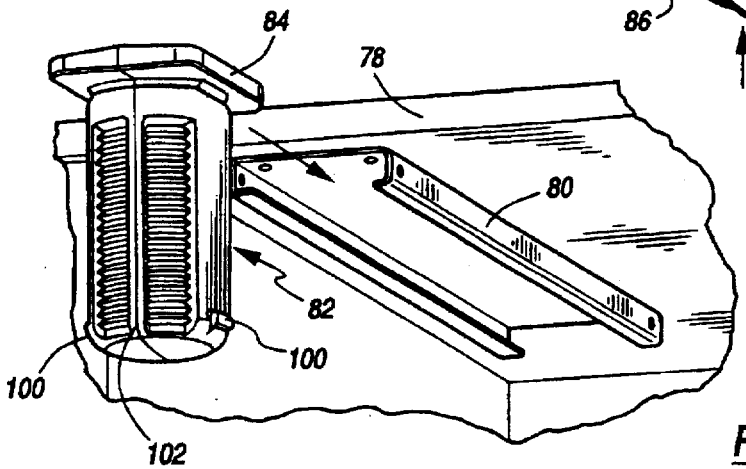
FIG. 10 is a side perspective view thereof with the mouse pad and associated support arm removed.
Figure 11:
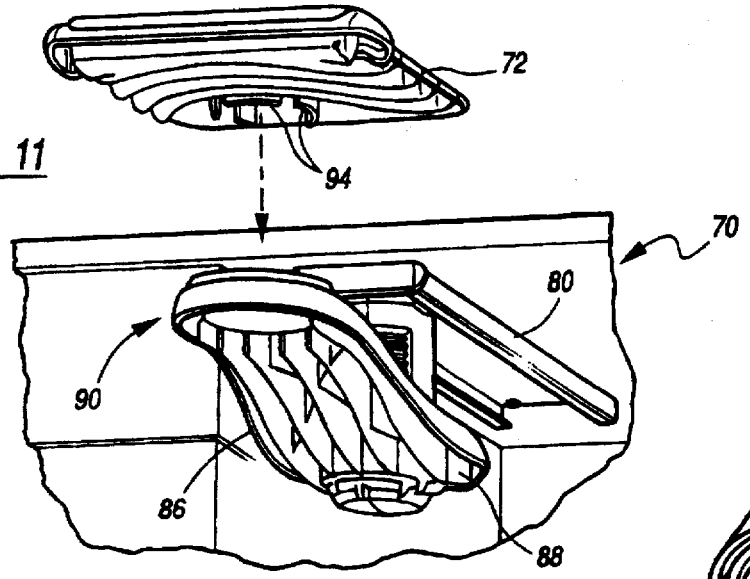
FIG. 11 is an exploded perspective view showing the mouse pad support assembly.
Figure 12:
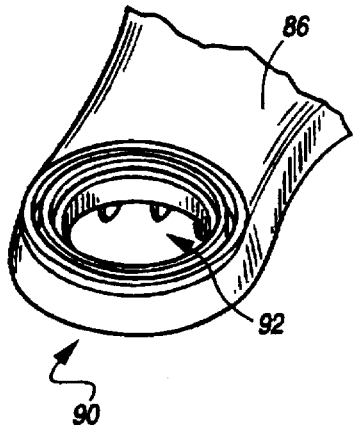
FIG. 12 is a fractional perspective view of one end of the support arm thereof.

Turning now to FIG. 8, in another form of the invention, an assembly 70 is illustrated for supporting a mouse pad 72 on which a computer mouse 74 may be operated. The pad 72 may include a suitable wrist rest 76. As seen in FIGS. 9 and 10, the assembly is mountable to the underside of a desk surface 78 by a generally C-shaped slide member 80 and vertical column member 82. The column member 82 in this embodiment has an enlarged upper end 84 which is dimensioned and configured to be slidingly received by the slide member 80. Thus, the column member 82 is movable with a degree of friction fore and aft of the desk surface 78. A support arm 86 has a collar portion at one end 88 configured to be slidable over the column member 82. At its other end 90, as best seen in FIGS. 11 and 12, the support arm 86 is provided with a circular aperture 92 for receiving circular locking tabs 94 formed integrally with the mouse pad 72. The mouse pad 72 may thereby be snapped into the aperture 92 and be supported for rotational movement on the support arm 86.

Figure 13:
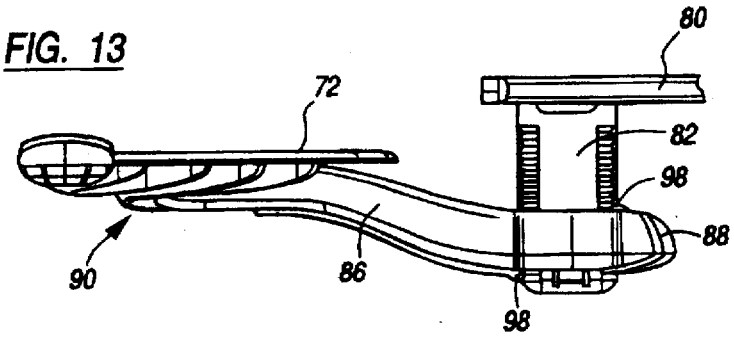
FIG. 13 is a side elevational view thereof showing the mouse pad positioned at one elevation relative to the desk.
Figure 14:
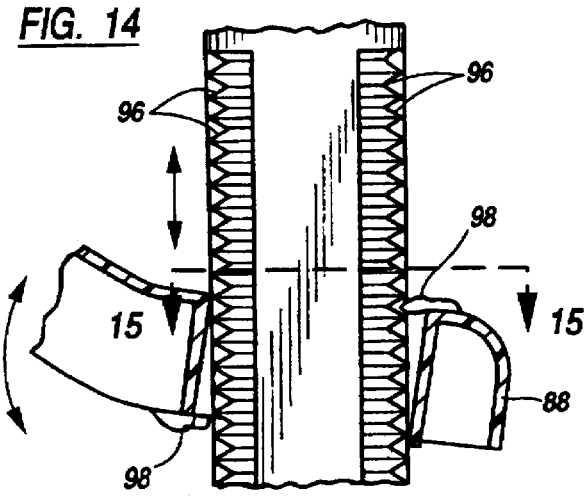
FIG. 14 is a fractional side elevational view of a mouse pad support assembly showing the assembly as being adjusted to a different elevational position.
Figure 15:
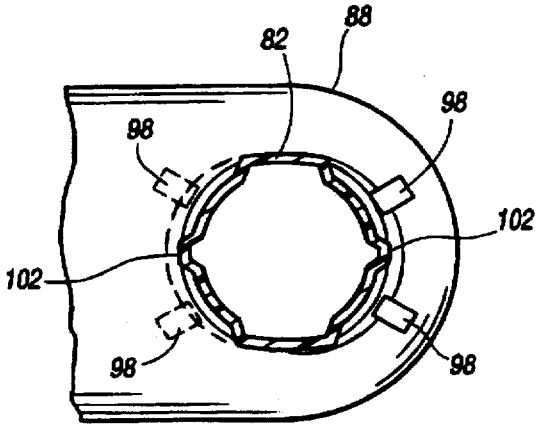
FIG. 15 is a cross-sectional view taken substantially along the line 15—15 of FIG. 14.

As seen in FIGS. 13–15, the column member 82, like the column member 26 of the keyboard support assembly 20, is provided with a series of vertically aligned opposed notches 96. Moreover, the collar portion 88 is provided with pairs of opposed teeth 98 aligned in registry with the notches 96 of the column member 82. Thus, as shown in FIG. 13, under the normal influence of gravity, the teeth 98 will engage the notches 96 and maintain the support arm 86 in one of several vertical positions relative to the desk surface 78. Further, if it is desired to adjust the height of the arm 86 and associated mouse pad 72, the end 90 of the support arm is simply lifted causing the collar portion 88 to cock slightly, whereby the teeth 98 disengage from the notches 96 and the arm 86 is free to slide up and down the column member 82. Suitable tabs 100, as best seen in FIG. 10, allow the collar portion 88 to snap over the column member 82 and thereafter prevent disassociation of the arm 86 from the member 82. The column member 82 of the assembly 70 is illustrated as a generally cylindrical member, although other shapes may readily be used. Thus, to key the arm 86 on the column 82 and prevent relative rotational movement of the arm 86, opposed vertical ribs 102 are formed on the column member 82 which abut the teeth 98 when the arm 86 is twisted. Preferably, the configuration of the ribs 102 and teeth 98 are such as to allow the arm 86 to rotate relative to the column member 82 through an angle of approximately twenty degrees. This allows the user to adjust the position of the mouse pad 72 relative to the desk surface 78 and keyboard, if desired. A suitable snap-in stop 104 (FIG. 9) may be provided to prevent the column member 82 from sliding out of the slide member 80.

It can now be appreciated that a support assembly 20 or 70 of the present invention offers a highly affordable alternative to prior art mechanisms for supporting computer accessories in a manner as to allow the accessories to be retractable under a desk surface and also be height adjustable. The slide members 60 and 80 may be readily manufactured as simple extruded members or they may be simply formed metal structures. Moreover, the column members 36 and 82 can be readily manufactured as plastic injection molded members comprising two identical halves which simply snap together. The respective support arms 26 and 86 are also readily manufactured as plastic injection molded parts. Thus, with only three simple components, the slide member, the column member and the support arm, a computer accessory such as a keyboard or mouse pad may be supported with full height adjustability and may also be retractable relative to a desk surface as to be conveniently stored out of the way when not in use. The novel use of teeth 40 and 98 and cooperating notches 38 and 96, respectively, of the assemblies 20 and 70, permits positive locking height adjustability without any need for complex mechanisms such as latches, springs linkages and the like. To raise or lower the arms 26 and 86 and adjust the position of the associated computer accessory, the user simply raises the ends of the arms 26 and 86 and cocks them relative to the column members 36 and 82 whereby the arms 26 and 86 may be adjusted to essentially any desired height on the column members 36 and 82, respectively.

It can further be appreciated that where it is desired to support a computer keyboard using the assembly 20 of the present invention, a simple slide arm 28, made by suitable injection molding techniques, may be provided for cooperation with a generally S-shaped arm 26 configuration as to provide keyboard tilt adjustability as well. Thus, with only four simple components, a keyboard may be retractable, and also height adjustable and tilt adjustable without the need for complex pantograph or other mechanisms as heretofore known. Accordingly, the support assemblies 20 and 70 may be manufactured at relatively low cost as highly functional devices and can correspondingly be made available to the consumer as relatively inexpensive products. The assemblies 20 and 70 also involve little effort to install, requiring the use of only a screwdriver to secure the slide members 60 and 80 to the underside of a desk or table surface, whereupon the other components are assembled manually without the need for any tools.

Although the invention has been illustrated in connection with embodiments having a keying arrangement between the respective columns 36 and 82 and cooperating support arms 26 and 86, it will be appreciated that arms can be readily supported on unkeyed cylindrical columns thus offering a rotating feature for supporting a keyboard, mouse or the like. Such a feature would provide further adjustability to suit the comfort of the user while still not involving the need for complex and expensive mechanisms.

While the present invention has been described in connection with preferred embodiments thereof, it will be apparent to those skilled in the art that many changes and modifications may be made without departing from the true spirit and scope of the present invention. Accordingly, it is intended by the appended claims to cover all such changes and modifications as come within the true spirit and scope of the invention.

What is claimed is:

1. Apparatus for supporting a computer input device on a desk comprising:

a generally elongate slide member configured for attachment to an underside of a work surface of a desk;

a generally elongate column member;

means cooperable between said slide member and said column member for retaining said column member in a vertical disposition relative to said desk work surface while permitting slidable movement of said column member longitudinally of said slide member;

an arm having a first end provided with means for supporting the computer input device and a second end provided with a collar, said collar being dimensioned and configured to be received around said column member; and means cooperable between said collar and said column member for retaining said arm in a series of discrete vertical positions on said column member to thereby provide height adjustability of said computer input device.

2. The apparatus of claim 1 wherein said cooperable means for retaining said arm on said column member includes a plurality of cooperating teeth and notches.

3. The apparatus of claim 2 wherein said teeth are provided on said collar and said notches are provided on said column member.

4. The apparatus of claim 3 wherein at least two pairs of said teeth are provided on said collar and said two pairs are arranged in opposed relation on opposite sides of a central opening in said collar.

5. The apparatus of claim 4 wherein a first portion of said plurality of teeth are located on a rear side of said collar and are elevated above a second portion of said plurality of teeth located on a front side of said collar wherein said teeth engage said notches under the normal influence of gravity acting on said arm when said apparatus is installed on a desk.

6. The apparatus of claim 1 wherein said slide member is generally C-shaped in cross-section and edges of said slide member cooperate with said column member to permit said slidable movement of said column member.

7. The apparatus of claim 1 wherein said means for supporting the computer input devices is supported on said arm by a slide arm and said slide arm is movable longitudinally of said arm.

8. The apparatus of claim 7 wherein said slide arm is movable by means of at least one rib and at least one slot for receiving said rib cooperating between said slide arm and said arm.

9. The apparatus of claim 8 wherein said arm is generally S-shaped and said slot and rib are generally curved whereby said means for supporting the computer input device is adapted to change angle of tilt when said slide arm is moved relative to said arm.

10. The apparatus of claim 9 wherein said angle of tilt is in a range of between approximately zero and fifteen degrees of horizontal.

11. The apparatus of claim 9 wherein said angle of tilt is toward the column member.

12. Apparatus for supporting a computer input device on a desk comprising:

an arm having first and second ends, said first end including means for attachment of said arm to a desk, said arm having a generally S-shaped side section;

a slide arm fixed to said arm by means of a rib and cooperating slot; and means for supporting the computer input device on said slide arm;

wherein said computer input device is adapted to be slidable relative to said arm and is adapted to be adjusted through differing angles of tilt by virtue of the curvilinear configuration of said arm.

13. The apparatus of claim 12 wherein said angles of tilt are in a range of between approximately zero to fifteen degrees from horizontal.

14. The apparatus of claim 12 wherein said angles of tilt are toward the column member.

15. The apparatus of claim 12 wherein said arm has a column member connected thereto and said column member is adapted to be connected to said desk and configured to provide height adjustability of said arm.

16. The apparatus of claim 15 wherein a plurality teeth and notches cooperate between said column member and arm to provide said height adjustability.

17. The apparatus of claim 15 wherein said column member is adapted to be mounted for slidable movement relative to said desk to thereby provide for retractability of said input device under said desk.

* * * * *